US006659597B2

(12) United States Patent
Murata et al.

(10) Patent No.: US 6,659,597 B2
(45) Date of Patent: Dec. 9, 2003

(54) LIQUID DISCHARGE HEAD

(75) Inventors: Tatsuo Murata, Kanagawa (JP); Masami Yokota, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/162,872

(22) Filed: Jun. 6, 2002

(65) Prior Publication Data

US 2002/0196313 A1 Dec. 26, 2002

(30) Foreign Application Priority Data

Jun. 15, 2001 (JP) ..... 2001-180998
May 30, 2002 (JP) ..... 2002-156650

(51) Int. Cl.[7] ..... B41J 2/05
(52) U.S. Cl. ..... 347/65; 347/56
(58) Field of Search ..... 347/20, 54, 56, 347/61, 63–65, 67, 50

(56) References Cited

U.S. PATENT DOCUMENTS 4,509,063 A 4/1985 Sugitani et al. ..... 347/65
5,521,621 A * 5/1996 Endo et al. ..... 347/56

* cited by examiner

*Primary Examiner*—Juanita Stephens
(74) *Attorney, Agent, or Firm*—Fitzpatrick, Cella, Harper & Scinto

(57) ABSTRACT

A liquid discharge head has an element base plate provided with a plurality of heat generating members and electrode wiring formed by thin-filmed electrode and common thick-filmed electrode for applying driving signals to the heat generating members, and with the structure arranged to form a flow path structural member to constitute discharge ports and liquid flow paths corresponding to each of the heat generating members, the common thick-filmed electrode is covered and sealed by the flow path structural member, and then, the driving IC assembled on an IC assembling and others are sealed by use of sealant, hence making it possible to secure the sealing capability, while making the distance between the common thick-filmed electrode and the driving IC smaller for the effective utilization of the area of the base plate. Thus, the element base plate can be made smaller.

16 Claims, 5 Drawing Sheets

LIQUID DISCHARGE HEAD

BACKGROUND OF THE INVENTION

1. Field of the Invention

The present invention relates to a liquid discharge head that performs print recording, image formation, or the like on a recording medium by discharging liquid form discharge ports as liquid droplets.

2. Related Background Art

A liquid discharge apparatus (ink jet recording apparatus) is the apparatus of the so-called non-impact apparatus that performs print recording, image formation, or the like on various kinds of recording media by discharging liquid droplets with the supply of ink or the like to the liquid discharge head, while driving the piezoelectric element or the electrothermal converting element (heat-generating member) in accordance with the driving signals corresponding to recording information or image information, which is known as the excellent recording apparatus in that it performs a high speed printing with a lesser amount of noises with some other advantages, and widely adopted for use of the printer, word processor, facsimile apparatus, copying machine, and others that carry a recording mechanism.

The liquid discharge head used for a liquid discharge apparatus of the kind has the electrothermal converting element arranged in the liquid flow paths for the liquid discharge head that uses the electrothermal converting element, for example. With the provision of driving signals that serve as discharge signals for such element, thermal energy is given to liquid. Then, the bubbling pressure of each liquid droplet exerted at the time of bubbling (boiling) of liquid, which is generated by the phase changes of liquid at that time, is utilized for liquid discharges.

Also, for the liquid discharge head that uses the electrothermal converting method described above, there are two types: one is the edge shooter type where liquid droplets are discharged in parallel to the surface of the base plate having the electrothermal converting element (heat-generating member) arranged; and the other is the side shooter type where liquid droplets are discharged perpendicularly to the surface of the base plate having the electrothermal converting element arranged.

Now, hereunder, with the example of a liquid discharge head of side shooter type, the specific structure of the conventional liquid discharge head will be described in conjunction with FIG. 4 to FIG. 6.

FIG. 4 is a perspective view that schematically shows the conventional liquid discharge head of side shooter type, observed from above. FIG. 5 is a cross-sectional view that schematically shows the liquid discharge head arranged along the direction (5—5 line) orthogonal to the arrangement direction of discharge ports represented in FIG. 4. Likewise, FIG. 6 is a partial cross-sectional view of the liquid discharge portion.

In FIG. 4 to FIG. 6, the element base plate 101 having the liquid discharge portion formed therefor is installed on the supporting member 120 through the holding member 121. On the surface side of the element base plate 101, there is arranged the flow path structural member 107 to form plural discharge ports 108 and liquid flow paths 111. Several tens or more of discharge ports 108 are provided for a actually finished product. Communicated with these discharge ports 108, the liquid flow paths 111 for supplying liquid are open almost in the same length as that of the discharge ports. Also, with the liquid flow paths 111, the liquid supply port 110 that supplies liquid from backside through the element base plate 101 and the liquid chamber 112, which is formed for the holding member 121, are communicated to arrange the structure in which the liquid chamber 112 receives the supply of liquid from outside.

As shown in FIG. 6, the heat-generating member (electrothermal converting element) 102 that gives heat to liquid for bubbling is provided for the element base plate 101 corresponding to each of the discharge ports 108. Also, the electrode wiring connected to each of the heat-generating member 102 is connected with the transistor circuit for driving the heat-generating member 102, respectively. For the transistor circuit, there have been known the method for incorporating such circuit on the element base plate 101 and the method for assembling the element incorporated in a separate member on the element base plate 101. Usually, for the element base plate 101 that has comparatively small numbers of heat-generating members 102 and discharge ports 108, it is generally practiced to adopt the method for incorporating the transistor circuit directly on the element base plate 101. However, in the case of the element base plate 101 that has comparatively large numbers of heat-generating members 102 and discharge ports 108 arranged for the purpose of widening the printing width, the structure that incorporates the transistor circuit on the element base plate tends to invite a significant reduction of production yield of element base plate. Therefore, the method for assembling the element incorporated on a separate member on the transistor circuit is considered advisable in terms of production yield. Here, the FIGS. 4 to 6 illustrate the example in which the transistor circuit incorporated on a separate driving element (driving IC) 113 is assembled on the element base plate.

FIG. 7 is a schematic view that shows the driving circuit of the kind for heat-generating member of the conventional ink jet recording apparatus. As described above, a plurality of heat-generating members 102 is provided, and one side of each wiring therefor is assembled by use of the block common wiring 301 on the VH power source side provided for each assembling (block) of the heat-generating members appropriately installed. Further, it is arranged to assemble each block common wiring 301 on the VH power source side by use of the head common wiring 302 on the VH power source. In this way, all the heat-generating members are electrically connected with the VH power source installed outside the recording head. The other wiring for heat-generating member 102 is connected with the driving transistor 1131 provided for the aforesaid driving IC 113 corresponding to each of the heat-generating members 102 one to one, respectively. The power supply line from the driving transistor 1131 is assembled by use of the block common wiring 303 on the GND side arranged per block, and assembled further by use of the head common wiring 304 on the GND side. In this way, all the heat-generating members are electrically connected with the electrodes of the VH power source and GND. Form the VH power source a constant voltage is supplied. The gate electrode of the driving transistor 1131 is connected with a driving control circuit (not shown), and with the appropriate control of the gate electrode, the heat-generating members 102 are driven arbitrarily to make an arbitrary image printing possible.

As shown in FIG. 6, the electrode wiring (not shown) connected with the heat-generating member 102 is connected to the thin-filmed electrode portion 103*a*, the common thick-filmed electrode portion 103*b*, and the IC assembling 104. Then, on the IC assembling 104, the driving IC 113 is assembled by the COB (chip on board) connection method using anisotropic conductive bonding film (ACF), solder bumps, or the like. Also, for the driving IC 113, the logic circuit and others are installed to drive transistor in addition to the transistor circuit for driving the heat-generating member 102. The logic circuit is connected with the flexible film (flexible wiring base plate) 114 through the electric connecting portion 104*a* formed at the edge of the element base plate 101. Further, the flexible film 114 is connected with the printed-circuit board (circuit base plate) 116, which is formed by a compound material of glass-epoxy and others. The printed-circuit board 116 has the electric connector 117 (FIG. 5) mounted in order to receive electric signals from outside. The flexible film 114 is folded substantially at right angle from the edge of the element base plate 101 along the side face of the supporting member 120, and the printed-circuit board 116 is fixed to the side face of the supporting member 120.

The thin-filmed electrode portion 103*a* connected with the heat-generating member 102, the common thick-filmed electrode portion 103*b*, the driving IC 113, and the electric connecting portion of the flexible film 114 are covered by a sealant 115, such as epoxy resin, excellent in sealing capability and ion insulation as shown in FIG. 6, because if the connecting portions are exposed, the electrodes and the base metal thereof are eroded by the adhesion of spreading liquid droplets from the discharge ports 108 and those bouncing off from the surface of a recording medium during print recording.

SUMMARY OF THE INVENTION

Now, when the driving IC 113, the common thick-filmed electrode 103*b*, the electric connecting portion of the flexible film 114, and others are sealed using a sealant 115 by the conventional art described above, it is generally practiced to adopt the method whereby to coat sealant 115 using a dispenser. This application of sealant aims at covering an object to be sealed completely so as to protect such portion sufficiently. However, in order to secure a sufficient protection and a sufficient sealing performance therefor, the coating area of the sealant should be arranged to be larger than that of the sealing object. As a result, there often encountered a problem that sealant spreads out from the sealing area, thus clogging the discharge ports 108. To counteract this, it is necessary to secure an area on the base plate for receiving the sealant that may spread out unavoidably. For the liquid discharge head, too, there is a need for the provision of such area to receive spread-out sealant (a margin prepared for receiving spread-out sealant) in order to perform sealing with a good production yield. Usually, it is required to provide a sufficient distance between the common thick-filmed electrode 103*b* and the driving IC. This ensues in a distinctive disadvantage in terms of efficiency needed for use of an expensive base plate. Also, in order to provide a smaller base plate, if the distance between the common thick-filmed electrode 103*b* and the driving IC is made smaller, while the coating amount and coating area of a sealant 115 are adjusted not to clog discharge ports 108, there often encountered a problem that the applied sealant 115 is not good enough to protect the common thick-filmed electrode 103*b* and the driving IC eventually.

Now, therefore, the present invention is designed to solve the problems of the conventional art as discussed above. It is an object of the invention to provide a liquid discharge head which is able to attain securing the sealing performance and effective utilization of the area of the head base plate simultaneously, and also, capable of implementing the cost down by increasing the obtainable numbers thereof per wafer with the smaller size of the head base plate by making the coating area of sealant for sealing the driving IC, electrode portions, and others smaller.

In order to achieve the object described above, the liquid discharge head of the present invention comprises discharge ports for discharging liquid, and a flow path structural member communicated with the discharge ports to constitute liquid flow paths for supplying liquid thereto formed on a base plate having discharge energy generating element for generating energy for discharging liquid, and electrode wiring formed by thin-filmed electrode and common thick-filmed electrode provided therefor. For this liquid discharge head, the flow path structural member covers the thick-filmed electrode.

It is preferable for the liquid discharge head of the invention to arrange the common thick-filmed electrode to be adjacent to the discharge ports, and also, to form the flow path structural member by photosensitive resin.

It is preferable for the liquid discharge head of the invention to arrange an IC assembling to be adjacent to the common thick-filmed electrode on the base plate, and while a driving IC is assembled on the IC assembling, the driving IC is sealed with sealant. In this case, the value of the distance between the common thick-filmed electrode and the driving IC should preferably be less than the value of thickness of the driving IC.

For the liquid discharge head of the invention, the discharge ports, common thick-filmed electrode, and driving IC are arranged in that order on the base plate, and the distance between the discharge ports and the common thick-filmed electrode should preferably be 5 mm or less.

It is preferable for the liquid discharge head of the invention to make the thickness of the common thick-filmed electrode 1 $\mu$m or more.

It is preferable for the liquid discharge head of the invention to provide water repellent process for the surface of the flow path structural member near the circumference of the discharge ports, and also, provide water repelling process for the surface of the flow path structural member on the common thick-filmed electrode.

In accordance with the present invention, the liquid discharge head is provided with the flow path structural member that constitutes the liquid flow paths and discharge ports on the element base plate having discharge energy generating element arranged thereon, while the electrode wiring formed by thin-filmed electrode and common thick-filmed electrode, and the IC assembling are arranged on the element base plate thereof in order to apply driving signals to the discharge energy generating element, and then, the driving IC assembled on the IC assembling and electrode portion are sealed with sealant. For this liquid discharge head, the flow path structural member covers and seals the common thick-filmed electrode so that the width of the area corresponding to the common thick-filmed electrode is used as the area that receives the sealant that may spread out when it is applied to seal the driving IC. Further, the water repellent layer, which is formed near the circumference of discharge ports on the liquid discharge surface of the flow path structural member, is also formed on the area corresponding to the common thick-filmed electrode. In this way, it is made possible to reduce the amount of spread-out sealant sill more for the applied to the driving IC.

Thus, the sealing performance and the effective use of the base plate area can be attained simultaneously, to make it possible to downsize the element base plate of a liquid discharge head and increase the obtainable numbers thereof per wafer for the implementation of cost reduction.

Furthermore, with the area to receive spread-out sealant 15 on the flow path structural member 7, the step between the upper surface of the driving IC 13 and the area to receive spread-out sealant becomes smaller by the thickness portion of the flow path structural member 7. As a result, it becomes easier to control the spread-out amount of sealant. Thus, the driving IC 13 can be sealed with a lesser coating amount of sealant. With the lesser coating amount of sealant, the amount of swelling of sealant 15 on the driving IC can be made smaller, and the distance between the discharge ports 8 and a recording medium is made shorter accordingly for the enhancement of discharge precision.

DETAILED DESCRIPTION OF THE PREFERRED EMBODIMENTS

Hereinafter, in conjunction with the accompanying drawings, the embodiments of the present invention will be described.

Figure 1:
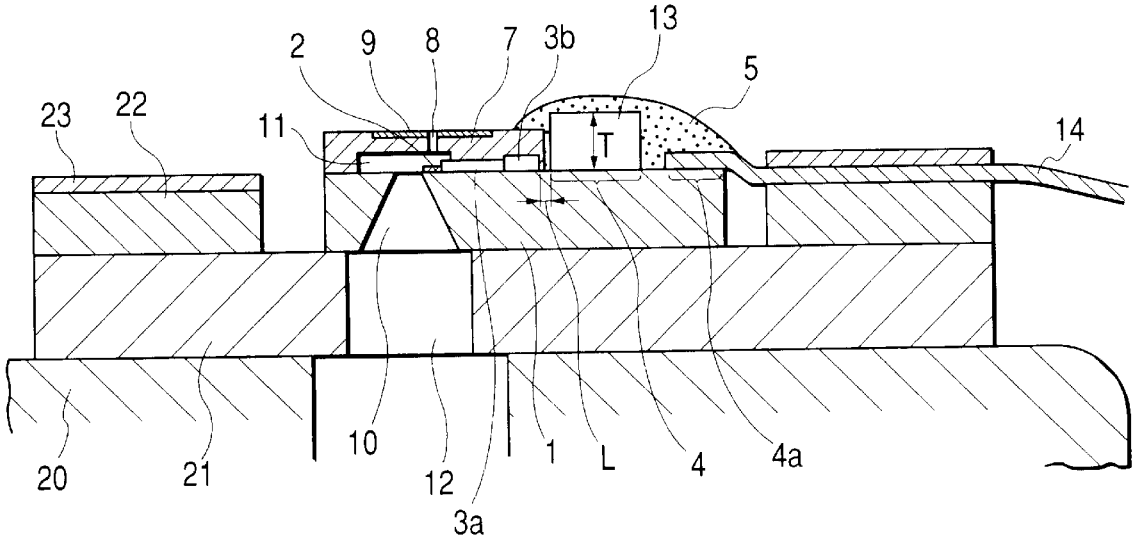
FIG. 1 is a partial cross-sectional view that shows the liquid discharge portion of a liquid discharge head, which is taken in the direction orthogonal to the arrangement direction of the discharge ports thereof, in accordance with one embodiment of the present invention.

FIG. 1 is a partial cross-sectional view that shows the liquid discharge portion of a liquid discharge head, which is taken in the direction orthogonal to the arrangement direction of the discharge ports thereof, in accordance with one embodiment of the present invention. FIGS. 2A to 2F are views that illustrate the manufacturing steps of the liquid discharge portion of the liquid discharge head in accordance with one embodiment of the present invention.

Figure 4:
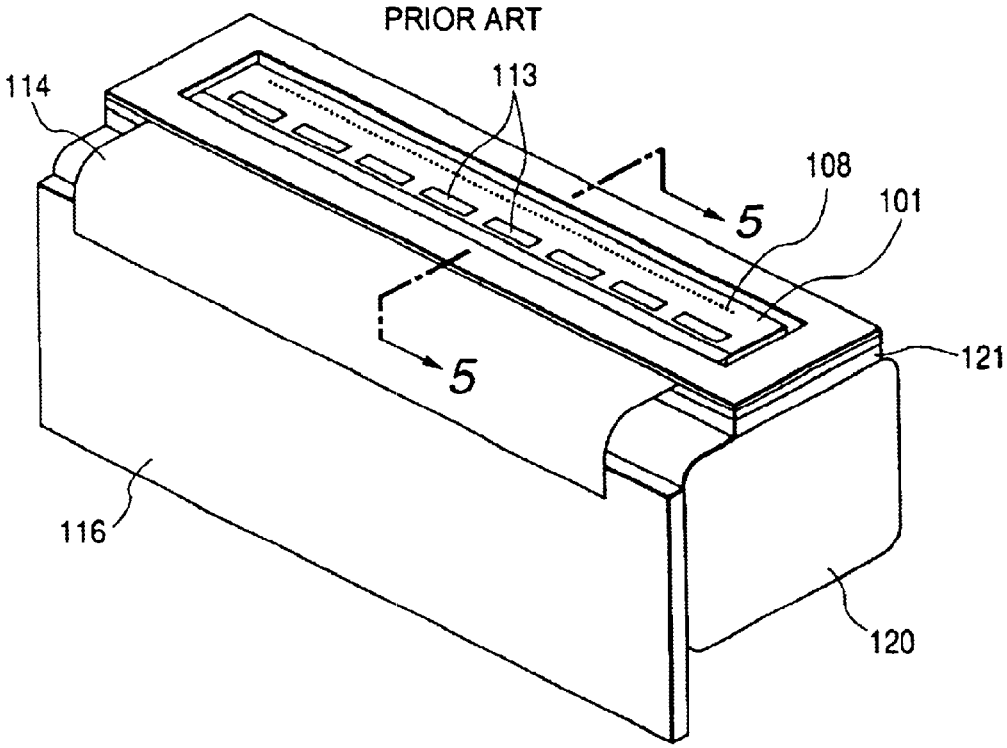
FIG. 4 PRIOR ART
FIG. 4 is a perspective view that schematically shows the conventional liquid discharge head observed from above the liquid discharge surface.
Figure 5:
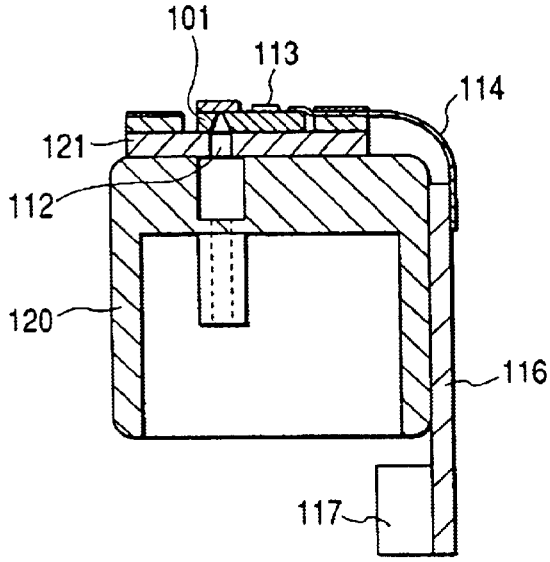
FIG. 5 PRIOR ART
FIG. 5 is a cross-sectional view that schematically shows the conventional liquid discharge head represented in FIG. 4, which is taken in the direction (5—5 line) orthogonal to the arrangement direction of the discharge ports thereof.
Figure 6:
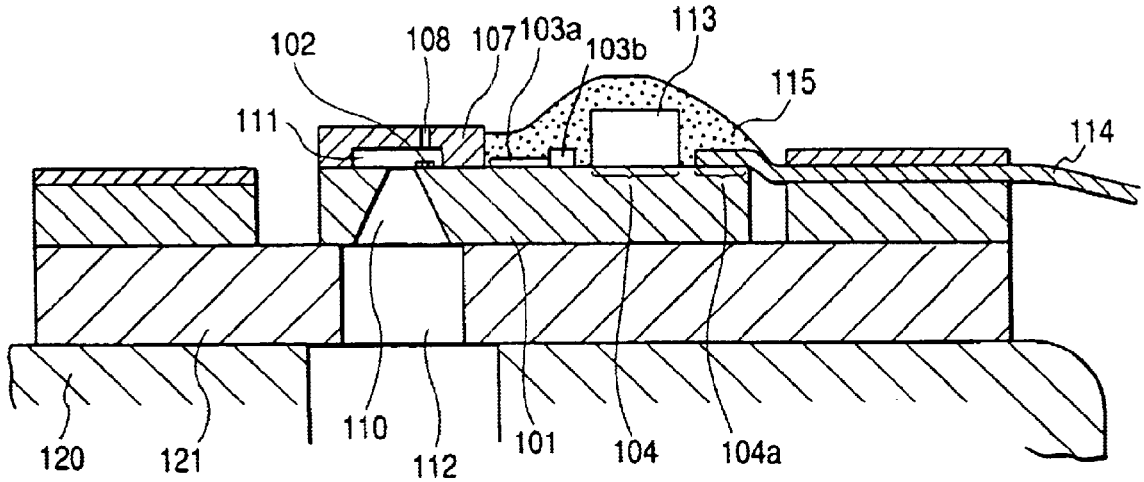
FIG. 6 PRIOR ART
FIG. 6 a partial cross-sectional view that shows the liquid discharge portion of the conventional liquid discharge head, which is taken in the direction orthogonal to the arrangement direction of the discharge ports thereof.

As shown in FIG. 1, the liquid discharge head that embodies the present invention is a liquid discharge head of side shooter type, which has a plurality of heat-generating members (electrothermal converting elements) 2 arranged as discharge energy generating elements on the element base plate 1 the basic material of which is Si, while forming the flow path structural member 7 that constitutes discharge ports 8 and flow paths 11 on the element base plate 1 corresponding to each of the heat-generating members 2, and discharges liquid in the direction perpendicular to the surface of the base plate having the heat generating members 2 when driving signals are applied to the heat-generating members 2. Further, on the element base plate 1 thereof, there are arranged the electrode wiring (thin-filmed electrode 3*a* and common thick-filmed electrode 3*b*) to apply driving signals to the heat-generating members 2 from outside, and the IC assembling portion 4 where the driving IC 13 is assembled, the electric connecting portion 4*a* that connects the flexible film (flexible wiring base plate) 14, and others. Here, the common thick-filmed electrode 3*b* and the IC assembling portion 4 are positioned adjacent to each other. The driving IC 13, on which the transistor circuit that drives the heat-generating members 2 and the logic circuit for driving the transistor are installed among some others, is assembled on the IC assembling portion 4 through the ACF (anisotropic conductive bonding film), and the flexible film 14 that supplies signals to drive the driving IC 13 is connected to the electric connecting portion 4*a* of the element base plate 1 through ACF and the like. Also, to the other end of the flexible film 14, the same printed circuit board (circuit base plate) formed by compound material such as glass-epoxy as shown in FIG. 4 and FIG. 5 (but not shown in FIG. 1) is connected. Then, the electric connector is installed to input electric signals from outside to the printed circuit board.

Also, in FIG. 1, a reference numeral 9 designates the water repellent layer, which is formed near the circumference of the discharge ports on the liquid discharge surface by means of water-repellent treatment, and 10, the liquid supply port formed to penetrate the element base plate 1, which is communicated with the liquid flow paths 11. This liquid supply port 10 receives liquid supplied from outside through the liquid chamber 12, which is provided for the holding member 21 and supporting member 20 to hold the element base plate 1 and supplies liquid to the liquid flow path 11 side. Also, a reference numeral 23 designates the front plate that forms the flat surface fixed to the holding member 21 through a spacer 22. The front plate 23 forms the portion that receives a cap (not shown) to close the area of the discharge ports 8 in order to prevent the volatile component of liquid from being evaporated when the liquid discharge head is on the standby for printing.

Here, the flow path structural member 7 that constitutes the liquid flow paths 11 and discharge ports 8 is covered to seal the common thick-filmed electrode 3*b*. In other words, when patterning the flow path structural member 7 that constitutes the liquid flow paths 11 and discharge ports 8 on the element base plate 1 by means of photolithographic art using photosensitive resin for the formation thereof, the common thick-filmed electrode 3*b* is formed in such a manner that it is simultaneously covered. Thus, at the same time that the flow path structural member 7 is formed, it becomes possible to cover the common thick-filmed electrode 3*b* by the flow path structural member 7. Here, the common thick-filmed electrode 3*b* can be sealed in good precision on the smallest possible area by baking the patterns using an aligner. Then, the driving IC 13 and the electric connecting portion 4*a* of the flexible film 14, and so on, are sealed by coating of sealant 15, such as silicon resin, which is excellent in sealing capability and ion insulation, by use of a dispenser. From the viewpoint of the protective performance, it is necessary to coat sealant 15 in an area larger than that of the object to be sealed when using the dispenser for sealing. For the present embodiment, however, the spread-out area (the extent of spreading out) of the sealant 15 can be kept within the area that corresponds to the common thick-filmed electrode 3*b*.

Next, with regard to the manufacturing steps shown in FIGS. 2A to 2F, the further description will be made of the liquid discharge portion of the liquid discharge head structured as described above.

Figure 2A:
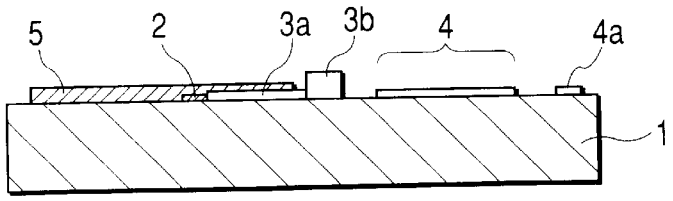
FIGS. 2A, 2B, 2C, 2D, 2E and 2F are views that illustrate the manufacturing steps of the liquid discharge portion of the liquid discharge head in accordance with one embodiment of the present invention.

As shown in FIG. 2A, TaN, which becomes the heat-generating member 2 that serves as the discharge energy generating element is filmed by sputtering in a film thickness of 0.03 $\mu$m on the element base plate 1, the basic material of which is Si, and patterned in a desired configuration by means of photographic technique. Then, the thin-filmed electrode 3*a,* common thick-filmed electrode 3*b,* IC assembling 4, electric connecting portion 4*a,* and others, which are connected to the heat-generating member 2, are formed in a thickness of 0.3 $\mu$m. The thin-filmed electrode is filmed on the heat-generating member 2 using Al-Cu, and patterned in a desired configuration by means of photolithographic technique. Also, the common thick-filmed electrode 3*b,* IC assembling 4, electric connecting portion 4*a,* and others are plated in a thickness of 5 $\mu$m using Au, Ni, Cu or others appropriately.

Particularly, for the so-called multiple array head that has the aforesaid nozzles over the entire area of printing width, for example, which is provided with many numbers of heat-generating members 2, it is effective to reduce electric resistance by increasing the film thickness of the common thick-filmed electrode 3*b* for the reasons given below.

Figure 7:
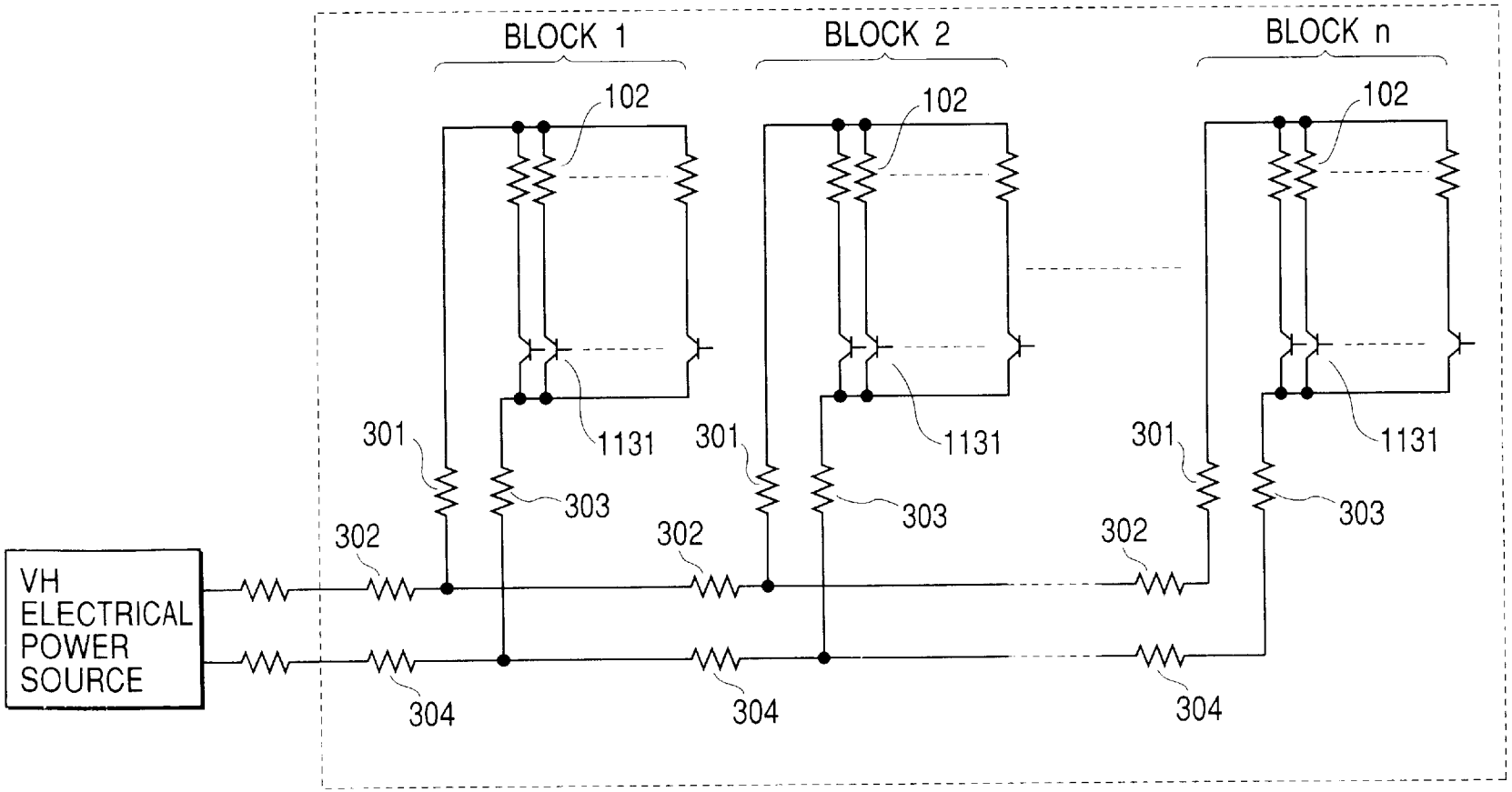
FIG. 7 is a diagram that schematically shows the electric circuit in conjunction with FIGS. 1, 2A, 2B, 2C, 2D, 2E, 2F, 3, 4, 5 and 6.

As shown in the circuit diagram represented in FIG. 7, the ink jet recording head thus structured heats ink serving as recording liquid to be bubbled by use of the heat-generating member 102 and enables it to be discharged. However, if the voltage value applied to the heat-generating member 102 should fluctuate to make the applying voltage to the heat-generating member 102 insufficient, bubbling defects occur to invite the degradation of printing quality, and the resultant prints become defective eventually. On the contrary, if voltage is applied to the heater 1501 excessively, the heater 1501 is overheated so as to generate the so-called re-boiling phenomenon where ink once bubbled is again bubbled after the initial bubble has contracted, and inappropriate ink discharge ensues to cause printing quality to be degraded or the heater life is made shorter due to the wire breakage or the like that may result from a large thermal stress exerted on the heat-generating member 102 by excessive heat given to the heat-generating member 102.

Here, the voltage drops in the circuit may vary depending on the patterns of printed images, and this causes the voltage applied to the heat-generating member 102 to fluctuate as described above.

Usually, the driving signals supplied to the heat-generating member 102 are arranged by time-division per block, which is described above. Therefore, the current that runs all the time on the common block wiring 301 on the power source side and the common wiring 303 on the GND side is only the portion corresponding to one piece of the heat generating member. However, the sum of the currents that run on the heat-generating members 102 selected per block runs on the aforesaid head common wiring 302 on the VH power source side and the head common wiring 304 on the GND side. In other words, the values of the currents that run the head common wiring 302 on the power source side and the head common wiring 304 on the ground side are made different depending on the numbers of heat-generating members 102 that may be driven at one time. At this juncture, the voltage drops fluctuate. As a result, the voltage applied to each of the heat-generating members 102 is caused to vary.

Thus, as described earlier, this fluctuation of applied voltage leads to the defective prints and the deterioration of the life of heat-generating member 102.

With respect to the problems described above, there is a need for making the resistors 302 and 304 to the head common wiring on the VH power source side and that on the GND side as small as possible, and also, a need for making the width of the head common wiring larger or the thickness thereof larger. However, if the width of the head common wiring should be made larger, this deviates from the objective of the present invention, namely, that the expensive base plate be used more effectively. On the other hand, if the head common wiring should be plated in a thickness of 1 $\mu$m or more or preferably, in a thickness of several $\mu$m to several tens of $\mu$m to reduce the wiring resistance, the reduction of voltage on the head common wiring portion can be suppressed without making the size of the ink jet head larger. Thus, it is possible to suppress the degradation of printing quality and re-boiling and the reduction of the life of the heat-generating member due to the fluctuation of voltage applied to the heat-generating member 102.

In this respect, the heat-generating member 2 and the common thick-filmed electrode 3*b* are arranged adjacent to each other at that time, and the distance between them is 5 mm or less. Then, on the heat-generating member 2 and a part of the thin-filmed electrode, the protection film 5 is formed in a thickness of 0.3 $\mu$m. The protection film 5 is an organic resin protection film, which is formed by patterning by means of photolithographic technique using HIMAL resin manufactured by Hitachi Chemical K.K.

Figure 2B:
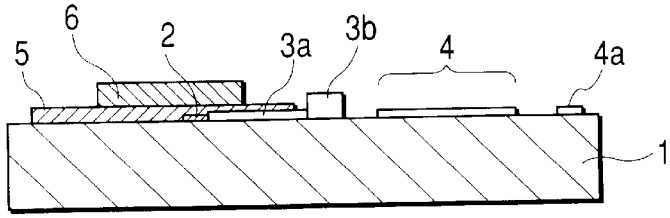

After that, as shown in FIG. 2B, the removable liquid flow path formation material 6 is coated on the protection film 5 and patterned corresponding to the heat-generating member 2. This becomes flow paths 11 later. The flow path formation material 6 is photosensitive resin (photo-resist ODUR manufactured by Tokyo Oka K.K., for example) and the patterning uses photolithographic technique for the implement of intended formation.

Figure 2C:
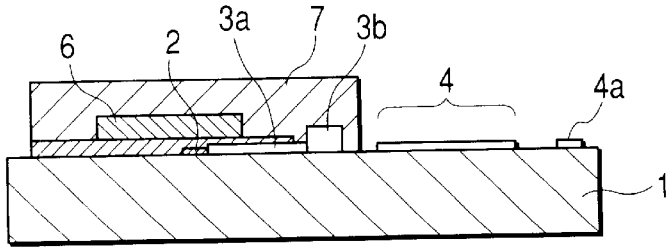

Then, as shown in FIG. 2C, the flow path structural member 7 is formed on the flow path formation material 6. As material for forming the flow path structural member 7, photosensitive resin (adekaoptomer CR 1.0 manufactured by Asai Dennka K.K., for example) is used. Patterning is performed by means of photolithographic technique, and this flow path structural member 7 is then patterned to cover the common thick-filmed electrode 3*b*. In this way, it is made possible to provide the flow path structural member 7 with the function to seal the common thick-filmed electrode 3*b*. At this juncture, an aligner is used to bake the pattern to make it possible to seal the common thick-filmed electrode 3*b* in good precision in the minimum area. Here, the thickness of the flow path structural member 7 is 50 $\mu$m.

Figure 2D:
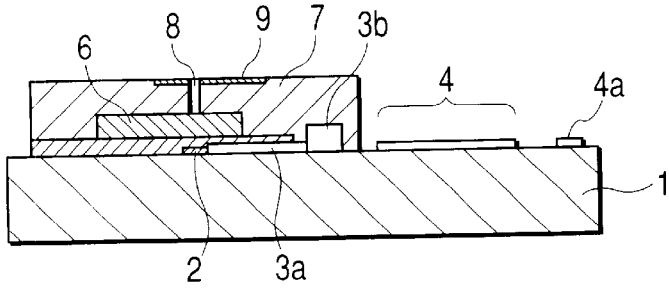

Next, as shown in FIG. 2D, the discharge ports 8 are formed on the flow path structural member 7 appropriately corresponding to the location of each heat generating member 2. Then, on the liquid discharge surface of the flow path structural member 7, water-repellent agent (PER 2.0 manufactured by Nippon Paint K.K., for example) is coated, and patterning is performed by means of photolithographic technique like the previous step to form the water repellent layer 9.

Figure 2E:
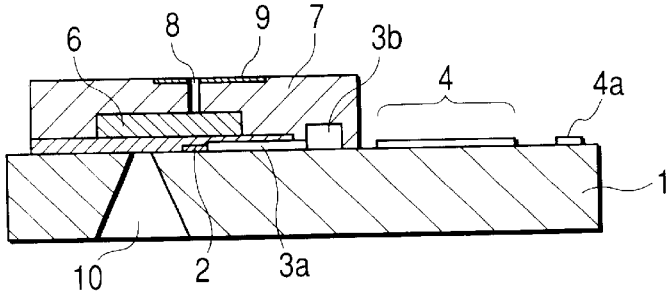
Figure 2F:
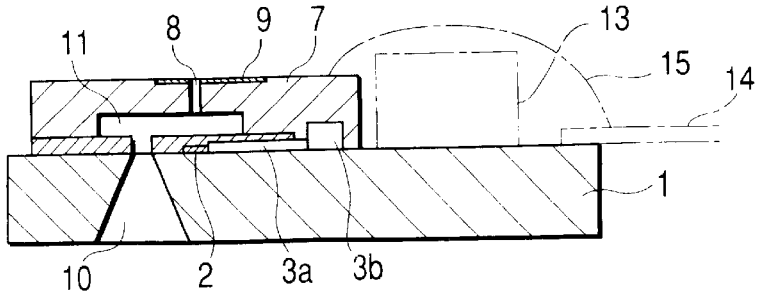

After that, as shown in FIG. 2E, the Si base plate 1 is etched from the backside thereof to form the through hole that becomes the liquid supply port 10. Thus, as shown in FIG. 2F, the liquid discharge portion is formed with the liquid flow paths 11 and discharge ports 8 corresponding to each of the heat generating members 2 by dissolving and removing flow path formation material 6 with the application of the removal agent, which is prepared dedicatedly therefor.

For the liquid discharge portion thus formed, the driving IC 13 in a thickness of 175 $\mu$m is assembled through ACF or the like on the IC assembling 4 on the element base plate 1. Also, with the electric connecting portion 4*a*, the flexible film 14 is electrically connected through ACF or the like. Here, the distance between the common thick-filmed electrode 3*b* and the driving IC 13 is 150 $\mu$m. Then, in order to prevent the driving IC 13, the electric connecting portion of the flexible film 14, and others from being stained by droplets flying from the discharge ports 8, and also, to shield them from the adhesion of droplets bouncing from a recording medium, a sealant 15, such as silicon resin, which is excellent in sealing capability and ion insulation, is coated on the driving IC 13 and the electric connecting portion of the flexible film 14 using a dispenser to implement covering and sealing of the driving IC 13 and the electric connecting portion of the flexible film 14, as shown in FIG. 1 and FIG. 2F.

As described above, the value of the distance L between the common thick-filmed electrode 3*b* and the driving IC 13 is made less than the value of the thickness T of the driving IC 13, and then, the common thick-filmed electrode 3*b* is covered and sealed by the flow path structural member 7. The area on the flow path structural member 7, which corresponds to that of the common thick-filmed electrode 3*b*, is used as the area of spread-out sealant 15. In other words, the area corresponding to the common thick-filmed electrode 3*b* is used as the area of spread-out sealant 15, thus using the area of the base plate effectively to make it possible to make the element base plate smaller. In this way, it is possible to achieve simultaneously a secure sealing capability and the effective utilization of the area of the head base plate. Also, it becomes possible to downsize the element base plate, thus increasing the obtainable numbers thereof per wafer for the reduction of manufacturing costs. Further, with the area of spread-out sealant 15, which is made available on the flow path structural member 7, the step between the upper surface of the driving IC 13 and the spread-out area is made smaller by the thickness portion of the flow path structural member 7. As a result, it becomes easier to control the spread-out amount of the sealant. Thus, even if the coating amount of sealant is made smaller, the driving IC 13 can be sealed by the sealant. Then, with the smaller amount of sealant, it becomes possible to make the swelling amount of sealant 15 smaller with respect to the driving IC, and to make the distance between the discharge ports 8 and a recording medium smaller accordingly for the enhancement of the discharge precision.

Figure 3:
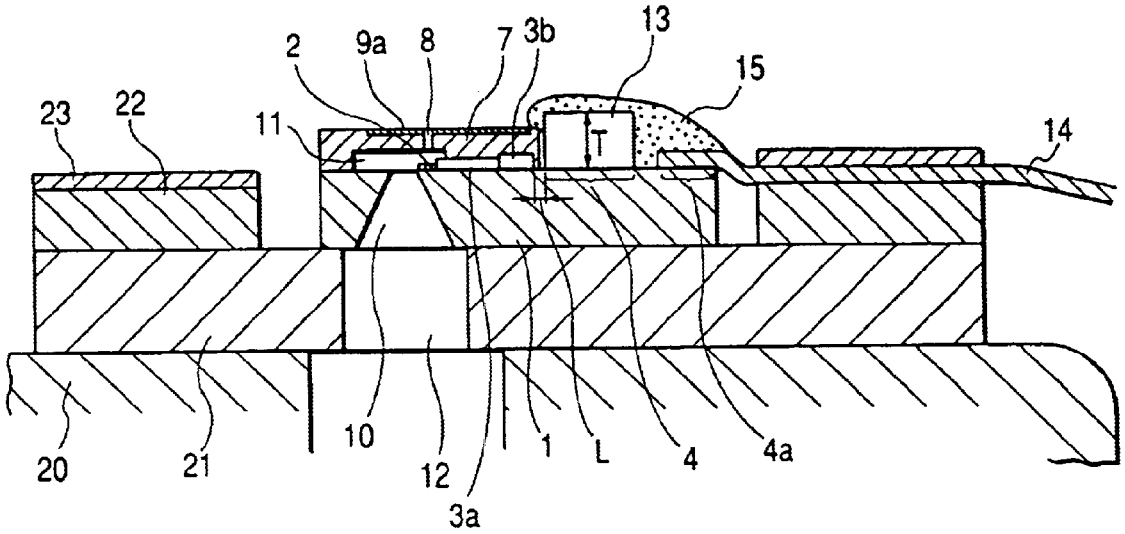
FIG. 3 is a partial cross-sectional view that shows the liquid discharge portion of a liquid discharge head, which is taken in the direction orthogonal to the arrangement direction of the discharge ports thereof, in accordance with another embodiment of the present invention.

Next, in conjunction with FIG. 3, the description will be made of another embodiment of the liquid discharge head in accordance with the present invention. FIG. 3 is a partial cross-sectional view that shows the liquid discharge portion of the liquid discharge head of another embodiment hereof, which is taken in the direction orthogonal to the arrangement direction of the discharge ports thereof.

As shown in FIG. 3, the present embodiment is different from the previous embodiment in that the water repellent layer 9*a*, which is arranged near the circumference of the discharge ports 8 of the liquid discharge surface of the flow path structural member 7, is provided also above the common thick-filmed electrode 3*b*. All the other structures and the method of manufacture are the same as those of the embodiment described earlier.

For the present embodiment, the water repellent layer 9*a*, which is formed near the circumference of the discharge ports 8 of the liquid discharge surface of the flow path structural member 7, is also arranged on the area corresponding to the common thick-filmed electrode 3*b* as shown in FIG. 3. In this way, when the driving IC 13 and others are sealed by use of sealant 15, the sealant 15 is not allowed to flow on the common thick-filmed electrode 3*b* due to the effect of the water repellent layer 9*a* on the common thick-filmed electrode 3*b*, thus making it possible to form the sealing film with a lesser amount of spread-out sealant. As a result, in accordance with the present embodiment, it becomes possible to demonstrate the same effect as that of the embodiment described earlier, while sealing the driving IC 13 and others with a lesser amount of spread-out sealant.

What is claimed is:

1. A liquid discharge head comprising:

discharge ports for discharging liquid; and a flow path structural member communicating with said discharge ports to constitute liquid flow paths for supplying the liquid thereto formed on a base plate having discharge energy generating elements for generating energy for discharging the liquid, and electrode wiring formed by a thin-filmed electrode and a common thick-filmed electrode provided therefor, wherein said flow path structural member covers said common thick-filmed electrode, on said base plate an IC assembling portion is arranged adjacent to said common thick-filmed electrode, and a driving IC is assembled on said IC assembling portion, said driving IC being sealed with sealant, and the distance between said common thick-filmed electrode and said driving IC is less than the thickness of said driving IC.

2. A liquid discharge head according to claim 1, wherein said common thick-filmed electrode is arranged adjacent to said discharge ports.

3. A liquid discharge head according to claim 1, wherein said flow path structural member comprises a photosensitive resin.

4. A liquid discharge head according to claim 1, wherein said discharge ports, said common thick-filmed electrode, and said driving IC are arranged in that order on said base plate, and the distance between said discharge ports and said common thick-filmed electrode is 5 mm or less.

5. A liquid discharge head according to claim 4, wherein the thickness of said common thick-filmed electrode is 1 $\mu$m or more.

6. A liquid discharge head according to claim 1, wherein the thickness of said common thick-filmed electrode is 1 $\mu$m or more.

7. A liquid discharge head according to claim 1, wherein a surface of said flow path structural member near circumferences of said discharge ports is given a water repellent treatment, and a surface of said flow path structural member corresponding to an area of said common thick-filmed electrode is also given a water repellent treatment.

8. A liquid discharge head comprising:

discharge ports for discharging liquid; and a flow path structural member communicating with said discharge ports to constitute liquid flow paths for supplying the liquid thereto formed on a base plate having discharge energy generating elements for generating energy for discharging the liquid, and electrode wiring formed by a thin-filmed electrode and a common thick-filmed electrode provided therefor, wherein said flow path structural member covers said common thick-filmed electrode, and the thickness of said common thick-filmed electrode is 1 μm or more.

9. A liquid discharge head according to claim 8, wherein the distance between said common thick-filmed electrode and said driving IC is less than the thickness of said driving IC.

10. A liquid discharge head according to claim 8, wherein a surface of said flow path structural member near circumferences of said discharge ports is given a water repellent treatment, and a surface of said flow path structural member corresponding to an area of said common thick-filmed electrode is also given a water repellent treatment.

11. A liquid discharge head comprising:

a substrate provided with a discharge energy generating element for generating energy for discharging liquid from a discharge port, and an electrode wiring for applying a driving signal to said discharge energy generating element; and a flow path constituting member for constituting said discharge port and a liquid flow path communicating with said discharge port to supply liquid thereto, said flow path constituting member being provided on said substrate such that said discharge port is located at a position opposed to said discharge energy generating element, and such that said flow path constituting member covers said electrode wiring, said electrode wiring being provided on the same side of the substrate as said discharge port.

12. A liquid discharge head according to claim 11, wherein said electrode wiring is formed by a thin-filmed electrode and a common thick-filmed electrode, and on said substrate an IC assembling portion is arranged adjacent to said common thick-filmed electrode, and a driving IC is assembled on said IC assembling portion, said driving IC being sealed with sealant.

13. A liquid discharge head according to claim 11, wherein said electrode wiring is formed by a thin-filmed electrode and a common thick-filmed electrode, and on said substrate an IC assembling portion is arranged adjacent to said common thick-filmed electrode, and a driving IC is assembled on said IC assembling portion, said driving IC being sealed with sealant, and wherein the distance between said common thick-filmed electrode and said driving IC is less than the thickness of said driving IC.

14. A liquid discharge head according to claim 11, wherein said electrode wiring is formed by a thin-filmed electrode and a common thick-filmed electrode, and on said substrate an IC assembling portion is arranged adjacent to said common thick-filmed electrode, and a driving IC is assembled on said IC assembling portion, said driving IC being sealed with sealant, wherein said discharge port, said common thick-filmed electrode, and said driving IC are arranged in that order on said substrate, and wherein the distance between said discharge port and said common thick-filmed electrode is 5 mm or less.

15. A liquid discharge head according to claim 11, wherein said electrode wiring is formed by a thin-filmed electrode and a common thick-filmed electrode, and wherein the thickness of said common thick-filmed electrode is 1 μm or more.

16. A liquid discharge head according to claim 11, wherein said electrode wiring is formed by a thin-filmed electrode and a common thick-filmed electrode, and wherein a surface of said flow path constituting member near a circumference of said discharge port is given a water repellent treatment, and a surface of said flow path constituting member on said common thick-filmed electrode is also given a water repellent treatment.

* * * * *